137-13 SR
11/3/81 XR 4,298,018

United States Patent [19]
Haggard

[11] 4,298,018
[45] Nov. 3, 1981

[54] PUMPING PROCESS

[75] Inventor: William J. Haggard, Cincinnati, Ohio

[73] Assignee: Chemed Corporation, Cincinnati, Ohio

[21] Appl. No.: 173,400

[22] Filed: Jul. 29, 1980

[51] Int. Cl.[3] ..... F17D 1/14
[52] U.S. Cl. ..... 137/3; 137/9; 137/13; 137/624.13; 222/630; 417/54
[58] Field of Search ..... 137/1, 3, 9, 13, 205.5, 137/268, 624.13, 624.15, 888; 222/630, 385, 318, 424; 417/151, 163, 170, 172, 181, 54

[56] References Cited

U.S. PATENT DOCUMENTS

| | | | |
|---|---|---|---|
| 1,643,025 | 9/1927 | Meggenhofen | 417/181 |
| 1,801,520 | 4/1931 | McMahon | 417/172 |
| 2,881,781 | 4/1959 | Tavernese et al. | 137/205.5 |
| 3,327,727 | 6/1967 | Anastasia | 137/888 X |

*Primary Examiner*—Alan Cohan
*Attorney, Agent, or Firm*—Charles L. Harness

[57] ABSTRACT

Method of pumping viscous liquids, e.g., detergents, using an eductor and a predetermined intermittent cycle.

4 Claims, 2 Drawing Figures

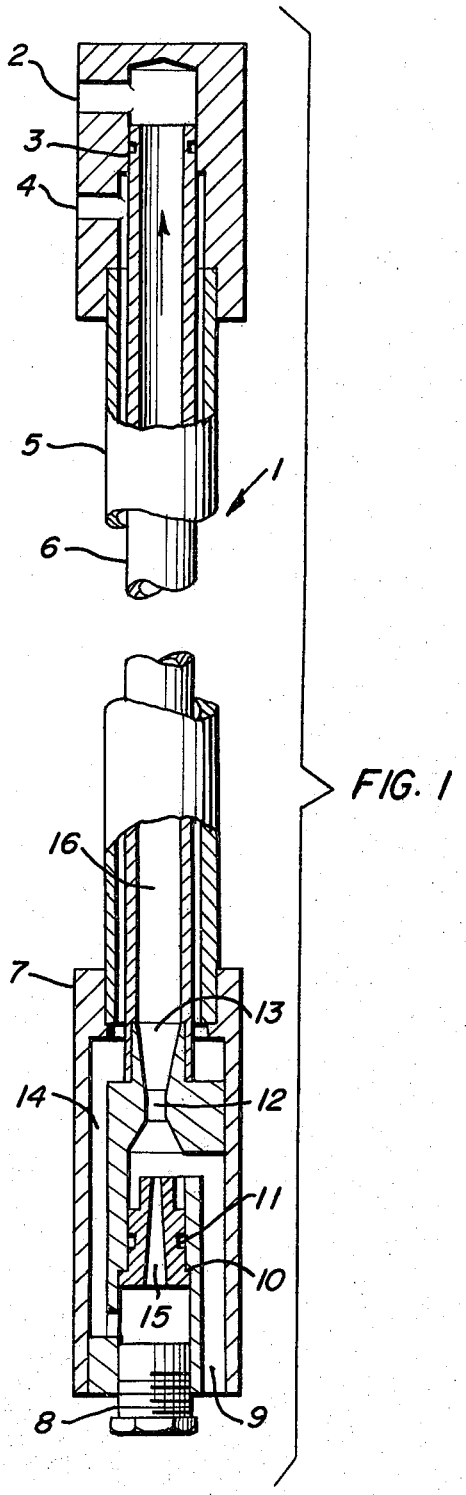
FIG. 1
FIG. 2
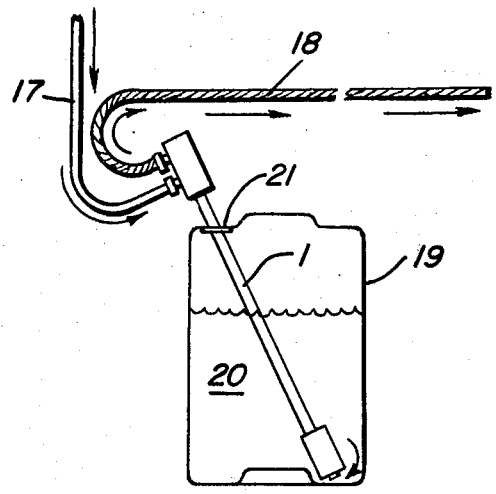

PUMPING PROCESS

This invention is directed to a process for pumping viscous liquids. The invention involves the use of an eductor, such as that hereinafter described, in a very special way. Firstly, the eductor is used to pump viscous, water-soluble liquids, i.e., liquids of 1,000 to 15,000 centipoises, typically liquid detergents. Second, the incoming (drive) liquid is water. Third, the eductor is necessarily submerged in the viscous liquid. Fourth, the eductor is used only intermittently, typically 30 to 60 seconds on, then three seconds off, then 30 to 60 seconds on again, and so on. The time "on duty" is about 90–95% of the total time from cycle to cycle.

In the drawings,

FIG. 1 shows an eductor typical of the type that can be used in the process of this invention. FIG. 1 shows the eductor in section with parts cut away.

FIG. 2 shows the eductor submerged in feed liquid.

Referring now more particularly to FIG. 1, the eductor is shown generally at 1. 4 shows the water supply inlet; the water flows down between the two tubes 5 and 6 to the bottom of the pump at 14. The water then makes a turn upward at 15 through the orifice or jet 10 into the throat of the eductor pump at 12, and then flows out through tube 13. It travels upward at 16 through tube 6 and out the discharge tube 2. This flow creates a suction at the suction feed inlet 9, thereby pumping the feed liquid up and into the water stream. Plug 8 closes the bottom of the pump but is removable. O-rings are provided at 11 and 3.

FIG. 2 shows use of the pump in feed liquid contained in a product shipper. The eductor pump is shown generally at 1. The feed liquid at 20 is contained in product shipper 19. The latter carries an inlet 21 for insertion of the eductor pump. The pump is equipped with water inlet line 17 and product outlet line 18.

In a typical operation, the product feed liquid is viscous water soluble detergent solution suitable for feeding to a dish machine or to a laundry operation. Such detergents are available commercially under trade names such as Eclipse. As noted, such liquids are difficult to pump with eductors. However, using the herein described procedure difficulties are minimized. The process is started by turning the water drive on two or three times for a couple of seconds each. This has the effect of mixing product liquid with water in the venturi section of the pump, (between jet 10 and throat 12), thereby reducing the viscosity of the liquid to a point where the pump can handle it in the forthcoming drive cycle. Following start-up, the water drive is turned on for about 30 seconds. This has the effect of pumping product liquid from the container and out to a suitable wash tank or other solution reservoir. The drive is then turned off. Following this drive cycle water in the system falls back down through tube 6, down to the venturi area and out into the product liquid, through inlet 9. There the dilute water-liquid solution mixes further with the product liquid, reducing the viscosity thereof in the immediate area of the pump. This makes it easy for the pump to handle the next intake on the next drive cycle. In a preferred embodiment a drive cycle of about 30 seconds is followed by a rest cycle of about 3 seconds, which then is followed by the next drive cycle, and so on. Overall the drive cycle should be about 90–95% of the total of drive cycle plus rest cycle.

The pressure at the water feed inlet 4 suitably varies between 10 and 100 psi. The volume of product liquid that may be pumped depends on the water pressure and also the dimensions of the orifice or jet 10. The orifice 10 is removable so that orifices of other sizes can be inserted to change the volume of water flow. Obviously change in water flow also changes the volume of product liquid pumped up through inlet 9. Orifice 10 can be changed to allow the volume of water to range from 0.25 gpm to 2 gpm at 30 psi. The water inlet line 17/4 can be any length or any size; however, a one-quarter inch I.D. line is preferred.

What is claimed is:

1. The method of pumping a viscous water soluble feed liquid with an eductor pump, said pump having (a) a venturi element;

(b) an inlet for drive liquid, said inlet feeding to the jet of the venturi element;

(c) an inlet for feed liquid, said inlet feeding to the area beyond the said jet;

(d) an outlet tube fed by the venturi element;

said pump being submerged in said feed liquid; using water as the drive liquid, said method comprising (1) driving water through the venturi element of the eductor pump on a drive cycle thereby dissolving water soluble liquid in the venturi element and forming a water solution thereof, which solution is driven up the outlet tube and out of the pump;

(2) stopping the drive cycle, whereupon water solution in the outlet tube sinks back down into the feed inlet, where it dilutes the viscous feed liquid in the area of the inlet; thereby initiating a rest cycle;

(3) alternately repeating Steps (1) and (2), the time of the drive cycle in (1) being about 90–95% of the total of drive cycle plus rest cycle.

2. Method according to claim 1 in which the drive cycle is about 30 seconds and the rest cycle is about 3 seconds.

3. Method according to claim 1 in which the feed liquid has a viscosity of about 1,000–15,000 cps.

4. Method according to claim 3 in which the feed liquid is a dish machine detergent.

* * * * *